United States Patent [19]

Satoh

[11] 4,332,653

[45] Jun. 1, 1982

[54] METHOD OF NITRIDING BY HIGH TEMPERATURE ELECTROLYSIS

[76] Inventor: Shinzoh Satoh, 2-21-15, Higashimachi, Kichijoji, Musashino-shi, Tokyo, Japan

[21] Appl. No.: 227,671

[22] Filed: Jan. 23, 1981

[30] Foreign Application Priority Data

Jun. 13, 1980 [JP] Japan ..... 55-79971

[51] Int. Cl.[3] ..... C25D 11/00

[52] U.S. Cl. ..... 204/140

[58] Field of Search ..... 204/140, 39

[56] References Cited

U.S. PATENT DOCUMENTS

| | | | |
|---|---|---|---|
| 1,929,252 | 10/1933 | Morris | 204/39 |
| 1,953,647 | 4/1934 | Darrah | 204/140 |
| 3,331,708 | 7/1967 | Buitkus | 204/39 |
| 3,726,772 | 4/1973 | Takahashi | 204/140 |

*Primary Examiner*—T. Tufariello

*Attorney, Agent, or Firm*—Robert E. Burns; Emmanuel J. Lobato; Bruce L. Adams

[57] ABSTRACT

A method of nitriding by high temperature electrolysis in which the works to be nitrided are dipped into a molten cyanide bath which contains low grade oxides of titanium and/or zirconium in a hot dispersed form as catalyst and maintained at a temperature range of 760°-850° C., and a direct current of 10-100 A/dm$^2$ density is conducted through said cyanide bath, using said works as anodes. Thus a nitrided case of exceedingly deep and high hardness is obtained onto the work surfaces within a very short operating time, due to the rapid nitriding reaction at such high treating temperature. The deformation of the nitrided work is very small despite such a high treating temperature. Further, the method is applicable to those materials like titanium, high alloy steels, cast irons, etc., which have been considered difficult to be nitrided by the conventional method.

8 Claims, No Drawings

METHOD OF NITRIDING BY HIGH TEMPERATURE ELECTROLYSIS

BACKGROUND OF THE INVENTION

This invention relates to improvements made on the method of nitriding disclosed in the Japanese Pat. No. 776055 (Japanese Patent Publication No. 49-41023) of the same inventor. In this method, a salt-bath including titanium and/or zirconium as catalyst is used, and the electrolysis is made at relatively low temperature of less than 500° C. Although nitrided case of considerably deep and high hardness is obtainable by this method, these characteristics are still confined to some extent, and besides that the method is only applicable to the low carbon, or low alloy-low carbon steels.

SUMMARY OF THE INVENTION

The method of the present invention is directed to the improvements of the above-mentioned nitriding method and resides in that the works desired to be nitrided are dipped into a molten cyanide bath, containing metallic titanium or zirconium, or a combination thereof and low grade oxides thereof in a hot dispersed form and maintained at a temperature range of 760°-850° C., and a direct current of 10-100 A/dm$^2$ density is conducted through said cyanide bath, using said works as anodes.

According to the method of the present invention, nitrided case of exceedingly deep and high hardness can be obtained onto the work surface within a very short operating time, because of the rapid nitriding reaction at such specific temperature range. Further, the method is applicable not only to the ordinary low carbon steels, which can be nitrided easily by the conventional method, but also to such special materials as titanium or titanium-base alloys, mar-aging steels, austenitic stainless steels, high speed steels, heat resisting steels, alloy tool steels, high carbon steels, spring steels and ordinary special steels for constructional use, as well as cast irons, which have been considered difficult to be nitrided by the conventional method.

Further, in case of manufacturing structural steels reinforced by the addition of nitrogen (reference to Japanese Pat. No. 860129), formation of the nitrided case of more than 10 mm depth has been attained onto the surface of small steel ingots and slabs, and this may contribute to the manufacture of the reinforced structural steels. Such a deep nitrided case may be obtained by a strong chemical reaction of the catalyst in the salt-bath together with the electrolysis at such high temperature range. Further, the deformation of the nitrided work is practically very small despite such a high treating temperature, and this may simplify the subsequent machining operations. The treating time can be shortened to about 1/6 of the ordinary carburizing and hardening method, and production of the parts may be improved remarkably by this method.

DESCRIPTION OF THE PREFERRED EMBODIMENT

In the present invention, a molten cyanide bath is used which contains metallic titanium and/or zirconium and low grade oxides obtained therefrom in a hot dispersed form.

Sodium cyanide or potassium cyanide, or the combination thereof may be used for the cyanide bath. Any other salts such as sodium carbonate, potassium carbonate, sodium chloride and potassium chloride may be added selectively in the amount of less than 30%, if necessary. To prepare the above cyanide bath containing the catalyst, metallic titanium, zirconium or a combination thereof is required, which can be obtained, for instance, by an electrolysis of an aqueous solution of a compound of titanium or zirconium such as titanium dichloride or zirconium dichloride, or both as disclosed for example in U.S. Pat. No. 3,074,860. The metallic substance deposited on the cathode which may be referred to herein as "activated" metallic titanium and/or zirconium—actually a steel plate is used for the cathode—is then immersed into the above-mentioned molten cyanide bath maintained at about 600° C. Then thus activated metal substance is dispersed into the bath to provide a cyanide bath containing the catalyst. The cyanide bath is then heated to a temperature range of 760°-850° C., and the works to be cyanided are dipped into the bath; a direct current of 10-1000 A/dm$^2$ is then conducted through the bath, using said works as anodes and the steel vessel itself as a cathode, until the required case depth is obtained on the work surface. The mechanism of the process may be explained as follows:

Explanation will be made with respect to a sodium cyanide bath containing a titanium catalyst as an example. The activated titanium metal in the molten cyanide bath is oxidized into low grade oxides of the formula TiO as shown by the following reaction; the resultant oxides are dispersed in the hot molten cyanide bath.

$$Ti+\tfrac{1}{2}O_2=TiO \quad (1)$$

nitriding is accelerated by the catalytic action of the dispersed TiO according to the reaction.

$$2NaCN+6Fe+TiO=2Fe_3N+Na_2O+2C+Ti \quad (2)$$

Reduced metallic titanium is oxidized again to TiO in the bath and thus the process may be repeated, while nitriding, due to the action of $Fe_3N$ takes place on the surfaces of the work. $Na_2O$ and 2C formed by reaction (2) come up to the surface of the molten salt. On the other hand, sodium cyanide in the bath is supposed to dissociate as follows:

$$NaCN=Na^{+}+(CN)^{-} \quad (3)$$

Nitriding is performed also by this $(CN)^{-}$ neutralized at anodes:

$$CN+3Fe=Fe_3N+C \quad (4)$$

The carbon formed by reaction (4) comes up to the surface of the molten salt. Thus according to the strong chemical reaction of the catalyst together with the electrolysis of the cyanide bath, at such specifically high treating temperature, nitrided case of exceedingly deep and high hardness may be obtained even onto the surface of such materials, which have been difficult to be nitrided by the conventional method. As to the treating temperature, it is difficult to obtain enough case depth for such material as austenitic stainless steels at the temperature below 760° C., and the slight deformation of the work is observed at temperature over 850° C., so that the temperature range of 760°-850° C. is considered most suitable.

EXAMPLE 1

Nitriding was performed on pure titanium plates under the following conditions:

| | |
|---|---|
| Cyanide bath: | content of the catalyst 250 ppm |
| Treating temperature: | 820° C. |
| Treating time: | 2 hours |
| Current density: | 50A/dm$^2$ |

The results are as follows:

| | |
|---|---|
| Nitrided case depth: | 0.3mm |
| Surface hardness: | Vickers more than 1,150 |

EXAMPLE 2

Nitriding was performed on the 18-8 type stainless steel plates under the following conditions:

| | |
|---|---|
| Cyanide bath: | The same composition as in Example 1. |
| Treating temperature: | 800° C. |
| Treating time: | 2 hours |
| Current density: | 60A/dm$^2$ |

The results are as follows:

| | |
|---|---|
| Nitrided case depth: | 0.35mm |
| Surface hardness: | Vickers more than 1,150 |

EXAMPLE 3

Nitriding was performed on the 0.45% C carbon steel plates under the following conditions:

| | |
|---|---|
| Cyanide bath: | The same composition as in Example 1. |
| Treating temperature: | 800° C. |
| Treating time: | 2 hours |
| Current density: | 80A/dm$^2$ |

The results are as follows:

| | |
|---|---|
| Nitrided case depth: | more than 2.0mm |
| Surface hardness: | Vickers more than 1,320 |

EXAMPLE 4

Nitriding was performed on the ordinary cast iron (JIS FC30) under the following conditions:

| | |
|---|---|
| Cyanide bath: | The same composition as in Example 1. |
| Treating temperature: | 820° C. |
| Treating time: | 4 hours |
| Current density: | 100A/dm$^2$ |

The results are as follows:

| | |
|---|---|
| Nitrided case depth: | more than 1.0mm |
| Surface hardness: | Vickers more than 1,000 |

Note: Core structure changed to austenite structure throughout the depth of more than 10 mm. Core hardness: Vickers 300 Av.

EXAMPLE 5

Nitriding was performed on the gears made of ordinary carbon steel (JIS S 35C) under the following conditions:

| | |
|---|---|
| Cyanide bath: | The same composition as in Example 1. |
| Treating temperature: | 800° C. |
| Treating time: | 30 min. |
| Current density: | 50A/dm$^2$ |

The results are as follows:

| | |
|---|---|
| Nitrided case depth: | more than 2.5mm |
| Surface hardness: | Vickers more than 1,320 |

It will be seen from the above examples that excellent results are obtained by the method of the present invention.

What is claimed is:

1. A method for nitriding a metallic workpiece by high temperature electrolysis in an electrolyte cell containing a cathode, a molten electrolyte bath having a cyanide as its essential ingredient and wherein said metallic workpiece acts as the anode comprising dispersing metallic titanium, zirconium or a combination thereof in the molten cyanide bath in a catalytic amount, whereby low grade oxides of said metallic titanium, zirconium or a combination thereof form in said molten cyanide bath in an amount effective to accelerate the nitriding reaction, wherein said metallic titanium, zirconium or a combination thereof is obtained by electrolyzing an aqueous solution of a compound of said titanium, zirconium or a combination thereof;

dipping said metallic workpiece into said molten cyanide bath containing said titanium, zirconium, or combination thereof at a temperature of about 760° to 850° C. and conducting a direct current of about 10 to 100 A/dm.$^2$ through said bath.

2. A process as defined in claim 1, wherein said metallic workpiece is comprised of titanium or ferrous material.

3. A process as defined in claim 1, wherein said metallic workpiece is ferrous material.

4. A process as defined in claim 1, 2 or 3, wherein said metallic titanium, zirconium or combination thereof is added to said molten cyanide bath in an amount of about 250 ppm.

5. A process as defined in claim 4, wherein metallic titanium is added to said bath.

6. A process as defined in claim 4, wherein metallic zirconium is added to said bath.

7. A process as defined in claim 4, wherein metallic titanium and zirconium are added to said bath.

8. A process as defined in claim 1, wherein said metallic titanium, zirconium or combination thereof is obtained by electrolyzing a solution of titanium dichloride, zirconium dichloride or combination thereof.

* * * * *